US005349573A

United States Patent [19]

Hiromori

[11] Patent Number: 5,349,573

[45] Date of Patent: Sep. 20, 1994

[54] TIMER

[75] Inventor: Junji Hiromori, Tokyo, Japan

[73] Assignee: Hiromori, Inc., Tokyo, Japan

[21] Appl. No.: 198,857

[22] Filed: Feb. 18, 1994

Related U.S. Application Data

[63] Continuation-in-part of Ser. No. 110,550, Aug. 23, 1993.

[30] Foreign Application Priority Data

Sep. 9, 1992 [JP] Japan ..... 4-69445[U]

[51] Int. Cl.[5] ..... G04F 8/00; G04B 37/00

[52] U.S. Cl. ..... 368/108; 368/276

[58] Field of Search ..... 368/3, 10, 69–73, 368/107–113, 276

[56] References Cited

U.S. PATENT DOCUMENTS 4,707,614 10/1987 Copley et al. ..... 368/72

4,888,748 12/1989 Lagasse et al. ..... 368/107

*Primary Examiner*—Vit W. Miska

*Attorney, Agent, or Firm*—Dilworth & Barrese

[57] ABSTRACT

The present invention discloses a timer capable of sounding a prescribed time and further capable of functioning as a calendar, a watch or a thermometer frequently used every day life by a simple method.

A hollow main body (1) is constituted by a plurality of square or rectangular side plates (3) with the same pattern connected to each other so as to form a polygonal cube frame and lids (4, 4*a*, 4*b*) having a configuration corresponding to that of the upper and lower openings of the polygonal cube frame. A pair of ON-contacts (5, 5) each in the shape of a stick are mounted at each inner surface of a time setting device (2) containing a spherical conductor (6) displaced within the frame with a reduced and almost the same pattern a that of the frame along with a connecting portion of a side plate (7). Thus, the timer is constituted in a manner such that the side plate (7) of the frame and time setting device are parallel each other. A preliminarily prescribed setting time (9) is indicated on the outer surface of the hollow main body (1).

4 Claims, 7 Drawing Sheets

TIMER

BACKGROUND OF THE INVENTION

This is a continuation-in-part application of U.S. patent application Ser. No. 08/110,550 filed on Aug. 23, 1993, now pending.

The present invention relates to a timer and more particularly relates to a timer having functions as a timer, a watch, a calendar or a thermometer.

Such a conventional timer for informing of the lapse of a prescribed time by sounding a buzzer etc. when a spring wound up along with setting graduations at the prescribed time returns to its original state or informing of the lapse of a prescribed time by sounding a buzzer etc. when the prescribed time displayed on a digital counter by pushing down a button etc. becomes zero through counting down, was publicly known.

However, according to the aforementioned method of setting a prescribed time by winding a spring, said method falls short of time accuracy and often a considerable degree of an error in time occurs between the prescribed time and the sounding time of the buzzer depending upon a setting manner of graduations. On the other hand, furthermore, according to the method of setting the prescribed time by means of a digital counter, time accuracy itself is sufficient and there occurs almost no error between the prescribed time. However, it is necessary to progress figures in turn which eventually takes time in order to set up the prescribed time. Further, it is sometimes considerably troublesome because even a prescribed time frequently used in everyday life must be set on all such occasions.

SUMMARY OF THE INVENTION

With the above in mind, it is an object of the present invention to provide a timer containing a circuit preliminarily setting prescribed embodiments with such functions as a timer, a calendar, a watch or a thermometer, a plurality of ON-contacts for actuating the circuit and a buzzer for informing the lapse of the prescribed time by sounding etc. due to the conduction caused by simultaneous touching a spherical conductor with the prescribed two ON-contacts so as to actuate the circuit.

The aforementioned object can be attained by a timer comprising a plurality of square or rectangular side plates with the same pattern being connected to each other so as to form a polygonal cubic frame, a main hollow body constituted by said cubic frame and further provided with lids corresponding to the upper and lower openings of said cubic frame. Two ON-contacts each in the shape of a stick are mounted along with connecting portions of each inner surface of side plates of a time setting device displaced within said main hollow body and further having the reduced and almost the same pattern of a side plate with that of a hollow body. Said time setting device contains a spherical conductor therein being displaced in a manner such that the side plates of said hollow body and that of the time setting device are parallel each other, a circuit with different functions each being set up at the pair of ON-contacts mounted at each of the side plates of the time setting device, thereby actuating the circuit through conduction of the pair of ON-contacts by means of the spherical conductor contained in said time setting device. Alternatively, the side plates of said hollow body and that of said time setting device are shifted $360°/2n$ (n=the number of an angle of a polygon) from a parallel state through rotation. Further, said different circuit functions each set up at the pair of ON-contacts adjacent to each other through connecting portions of the side plates of said time setting device, thereby actuating the circuit through conduction of the pair of ON-contacts. An indicator is provided for indicating each of the circuit functions conducted through selection, the functions being indicated at the lid of the hollow main body.

By rotating an angle of $360°/2n$, the opposing side plates and connecting portions of the main hollow body and time setting device are shifted in a manner such that the side plates of the hollow body and the connecting portions of the side plates of the time setting device or the connecting portions of the side plates of the hollow body and the side plates of the time setting device are opposed. Thus, when the timer is brought down in such a manner that an optional side plate of said hollow body may be situated at the base thereof, the connecting portion of the side plate of the time setting device within the hollow body is situated downwards. (Refer to FIGS. 5–7)

For example, in the case of a triangular cube, i.e. a trigonal prism, the time setting device is fixed to the inner surfaces of said triangular cube by rotating 60°, i.e. shifting $360°/2\times3$; 45° in the case of a quadrilateral cube and 36° in the case of a pentagonal cube. When the time setting device is fixed thereto through rotation, the circuit is preliminarily set up in a manner such that the ON-contacts adjacent each other through connecting portions of the side plates may constitute a pair of ON-contacts.

The timer setting up different embodiments each at the pair of ON-contacts according to the present invention may provide a timer wherein a plurality of different times are set up respectively. Further it is possible to provide another timer with the embodiment of a calendar, a watch or a thermometer by providing the circuit with the functions as above.

Since the pair of ON-contacts each are mounted at each inner surface of the side plates of the time setting device, a face of the side plates is situated downwards by bringing the timer down in an optional direction so as to activate the timer from the state of non-use. The spherical conductor situated downwards within the timer setting device is moved to be situated on the inner surface of the side plate pursuant thereto so as to conduct the pair of ON-contacts mounted at the inner surfaces of said side plates through said spherical conductor, thereby sounding the buzzer after the lapse of a prescribed time due to actuating the circuit or indicating the selected embodiment on the indicator. Furthermore, in the case that the time setting device displaced within the hollow body is fixed thereto by shifting a certain angle through rotation, when a face of the side plates of the main hollow body is moved to be situated downwards by bringing said hollow body down in the direction such that the opposing face thereto indicating an optional prescribed time may be situated at the top surface of the main hollow body so as to activate the timer from the state of non-use. The spherical conductor situated downwards within the time setting device is moved to be situated onto the connecting portion having a configuration of a substantially V-shaped groove, so as to conduct two ON-contacts opposing each other between said connecting portions by means of the spherical conductor, thereby sounding the buzzer after the lapse of a prescribed time due to actuating the circuit through said conduction or indicating the selected embodiment on the indicator.

DESCRIPTION OF THE PREFERRED EMBODIMENTS

Figure 2A:
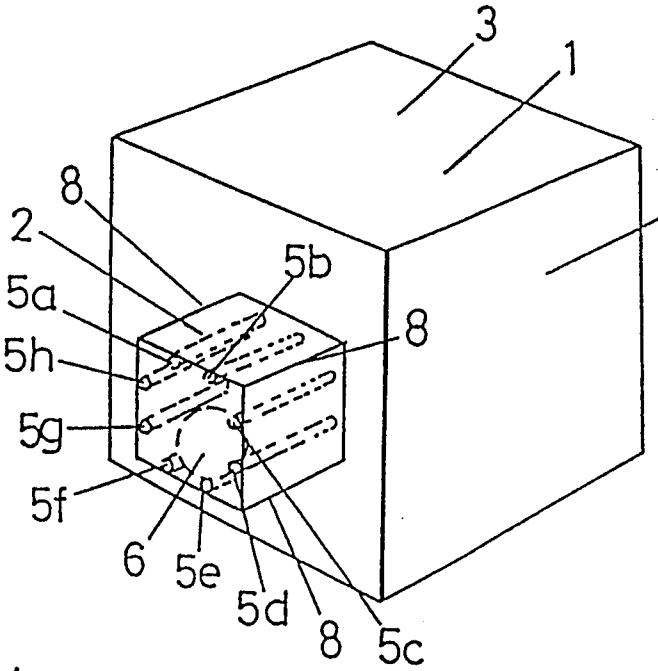
FIG. 2A is a perspective view to show the structure of said timer.
Figure 2B:
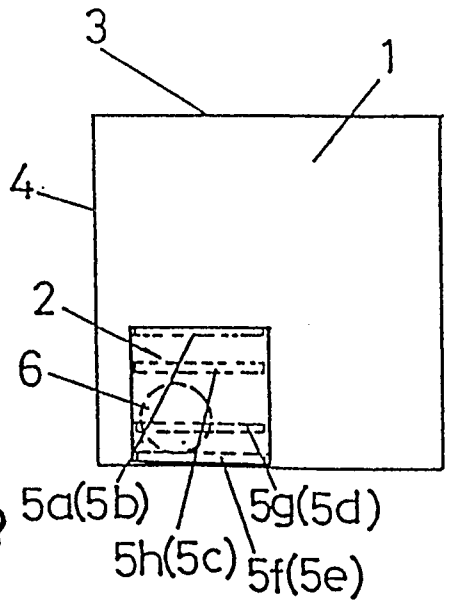
FIG. 2B is a right side perspective view thereof and FIG. 2C is a front perspective view thereof.
Figure 1:
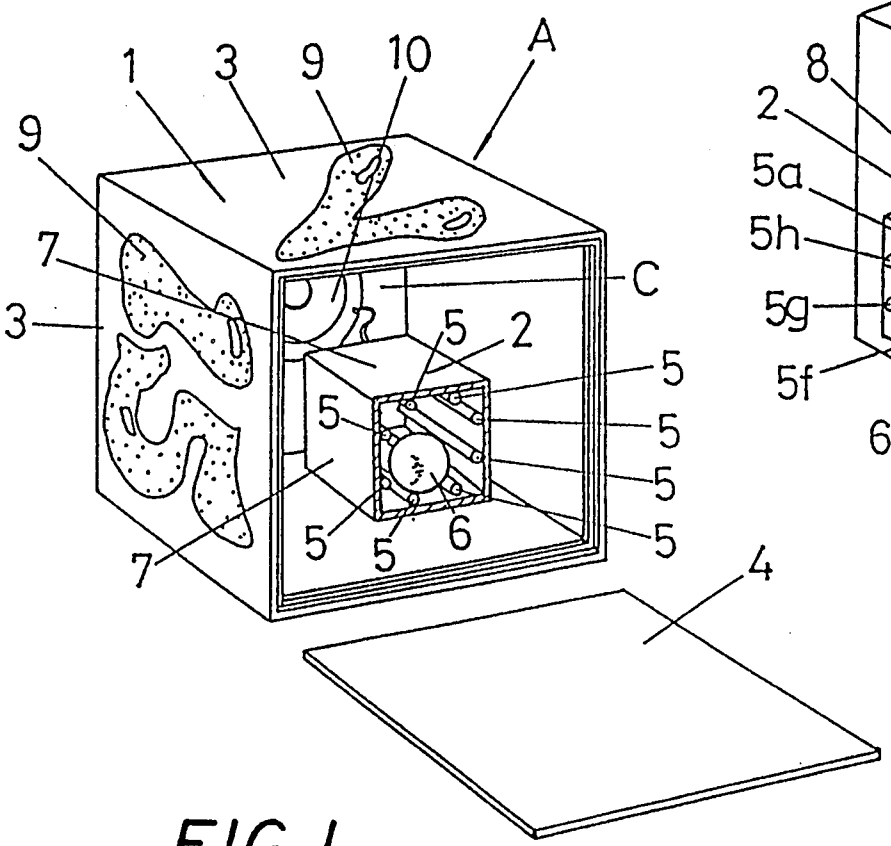
FIG. 1 is a perspective view to show embodiment of use of a timer according to the present invention, wherein a lid is taken out.
Figure 4:
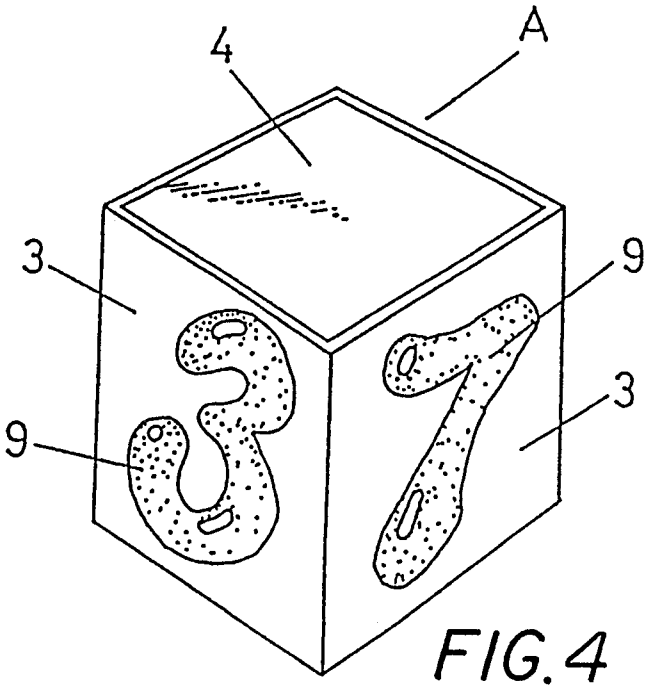
FIG. 4 is a perspective view thereof to show the status of its non-use.
Figure 3:
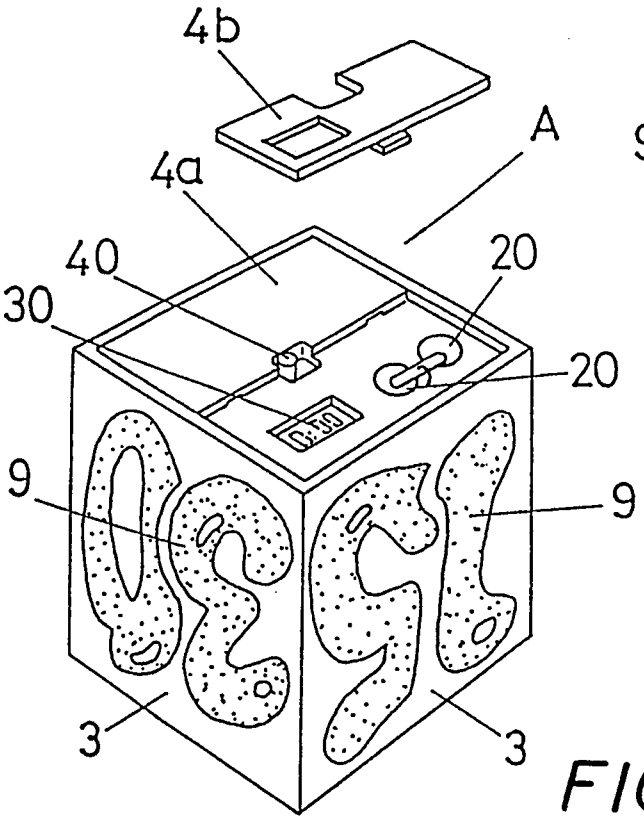
FIG. 3 is a perspective view thereof to show a process for commencing use thereof.
Figure 2C:
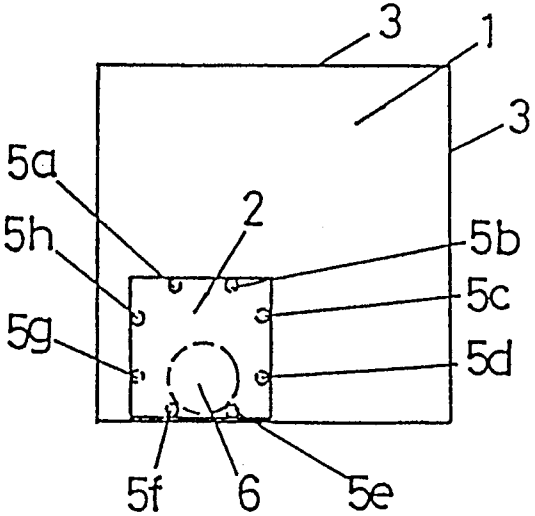

Hereinafter, embodiments according to the present invention will be described in detail with reference to the drawings.

As illustrated in FIGS. 1–4, a timer A according to the present invention is constituted as set forth hereinafter.

Square or rectangular side plates 3 with the same pattern, e.g. four plates, are connected to each other to constitute a quadrilateral cube frame. A main hollow body 1 provides with lids 4, 4*a*, 4*b*, corresponding to the upper and lower openings of said quadrilateral cube frame. (In FIG. 1, said frame is turned upside down in order to use the timer).

Within said main hollow body 1, a pair of ON-contacts in the shape of a stick 5*a* . . . 5*h* along with each connecting portion 8 of the side plates 7 of a time setting device 2 are mounted at each inner surface of said side plates 7 having the reduced and almost the same pattern with that of said main hollow body 1. Said time setting device 2 fixed to the inner surfaces of the side plates of the hollow body 1 and containing a spherical conductor 6, for example a steel ball, is displaced within the main hollow body in a manner such that the side plates of said time setting device 2 and that of the main hollow body 1 are parallel each other. Further, further an indicator 30 for indicating the embodiment of a circuit C conducted through selection is indicated on the lid 4 of the hollow body 1. 10 is a buzzer fixed to one of the lids of the main body 1, from which said lids 4*a*, 4*b* are separable. 20 is a battery.

Optional four kinds of a prescribed time which are frequently used in everyday life are preliminarily set in the course of the production process of the timer in the case of a quadrilateral cube and the circuit employed is a conventional one for attaining the object of the present invention.

When the timer A providing with a timer function only is turned upside down in a manner such that a face of side plates of the hollow body 1 indicating a prescribed time 9 thereon, for example 7 minutes, is situated on the top surface thereof after turning on a switch 40, the steel ball 6 abuts a pair of ON-contacts 5*e* 5*f*, thereby actuating the circuit due to the conduction of the ON-contacts 5*e* 5*f* so as to actuate the circuit and a buzzer in a desired time, i.e. 7 minutes. The switch 40 is a main switch and usually is in a state of ON and when the timer is in the state of non-use, said switch indicates 0:00 on the indicator 30.

On the other hand, when the timer A is provided with the other embodiments as a calendar, a watch and a thermometer in addition to a timer, the selected embodiment is indicated on the indicator by turning the timer upside so as to select an optional embodiment.

Figure 5C:
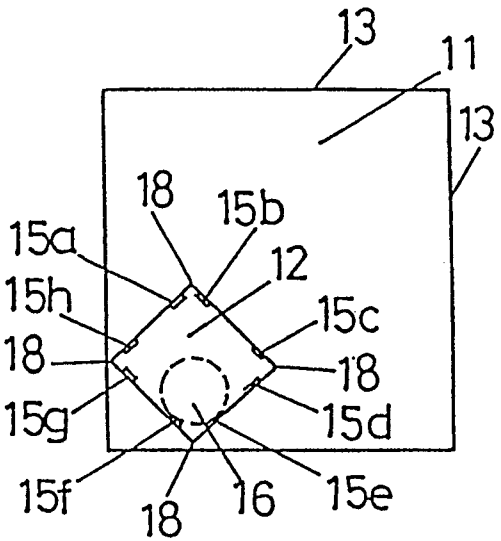
FIG. 5B is a right side perspective view thereof and FIG. 5C is a front perspective view thereof.
Figure 5B:
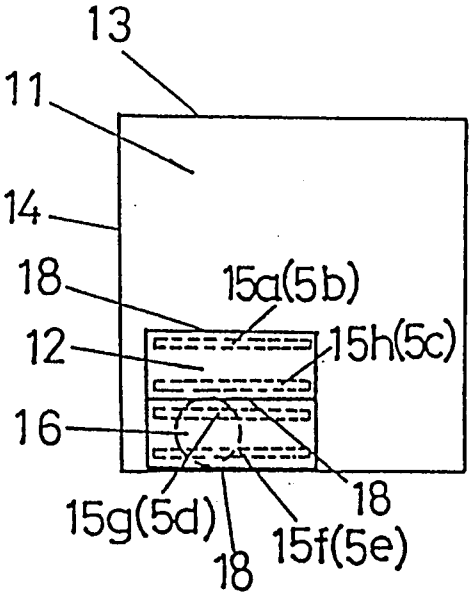
Figure 5A:
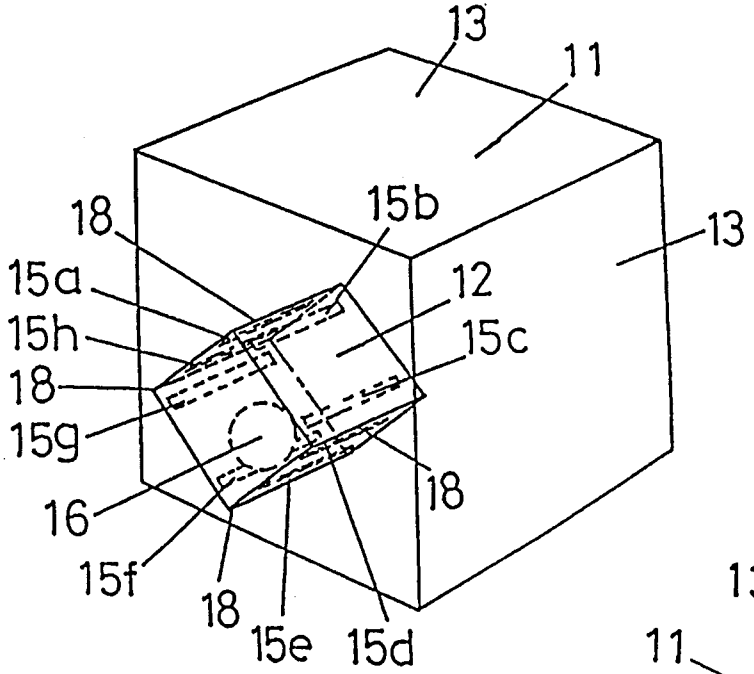
FIG. 5A is a perspective view to show another embodiment of the timer according to the present invention.

As illustrated in FIG. 5, a time setting device 12 fixed to the inner surfaces of the side plates 13 of a main hollow body 11 is displaced in a manner such that when the side plates of said hollow body and that of the time setting device are shifted $360°/2n$ from a parallel state through rotation (n=the number of an angle of a polygon), e.g. 45° in the case of a quadrilateral cube. The connecting portions 18, 18 of the side plates of the time setting device 12 are situated downwards so as to form a groove substantially in the shape of V, thereby receiving the spherical conductor thereon easily and steadily. 15*a* . . . 15*h* are ON-contacts and 16 is a conductor.

Figure 6:
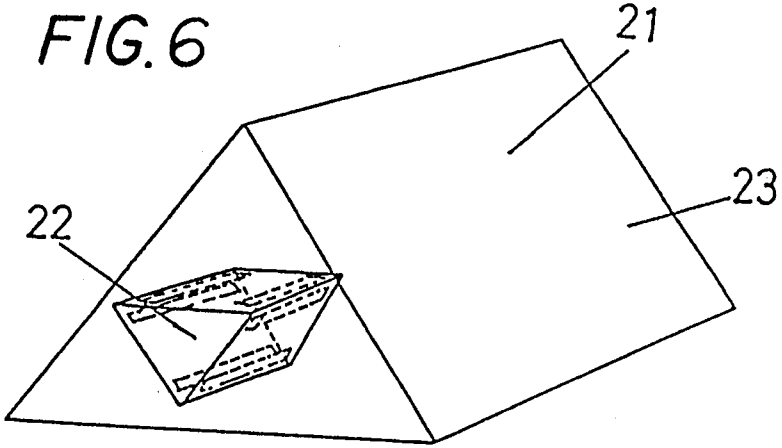
FIG. 6 is a perspective view of still another embodiment of the structure illustrated in FIG. 5.

A timer illustrated in FIG. 6 is constituted in a manner such that three square or rectangular side plates 23 with the same pattern are connected to each other to form a main hollow body 21 of a triangular cube, i.e. a trigonal prism. Further, a time setting device 22 is fixed to the inner surfaces of said triangular cube by rotating 60° i.e. $360°/2n$ (n=the number of an angle of a polygon).

Furthermore, when ON-contacts 5, 5 of the time setting device 2 are formed as a coiled conductor (not illustrated), the spherical conductor is put on said ON-contacts. Thus, the coiled conductor can absorb a potential oscillation caused by rolling about said spherical conductor, thereby always keeping a preferable state of ON-contact.

Figure 7:
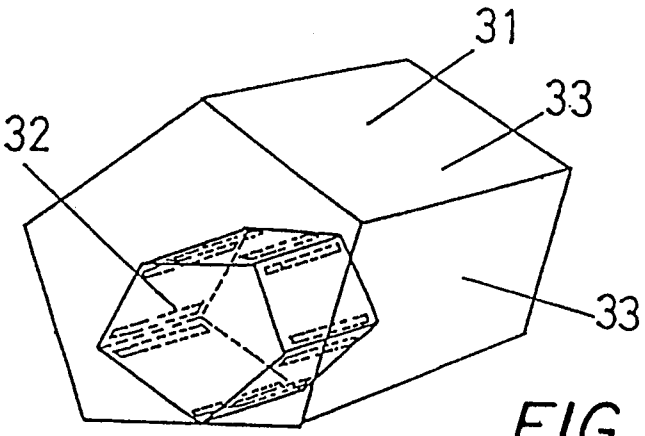
FIG. 7 is a perspective view of still further another embodiment of the structure illustrated in FIG. 5.

A timer illustrated in FIG. 7 is constituted in a manner such that five square or rectangular side plates 33 with the same pattern are connected to each other to form a main hollow body 31 of a pentagon cube, i.e., a pentagonal prism. A time setting device 32 is fixed to the inner surfaces of said cube rotating 36°, i.e. shifting $360°/2n$ (n=the number of an angle of a polygon).

The above two kinds of the timers are other embodiments of the present invention having the same technical concept as that of the timer illustrated in FIG. 5 and therefore a desired polygonal timer can be obtained.

Figure 8C:
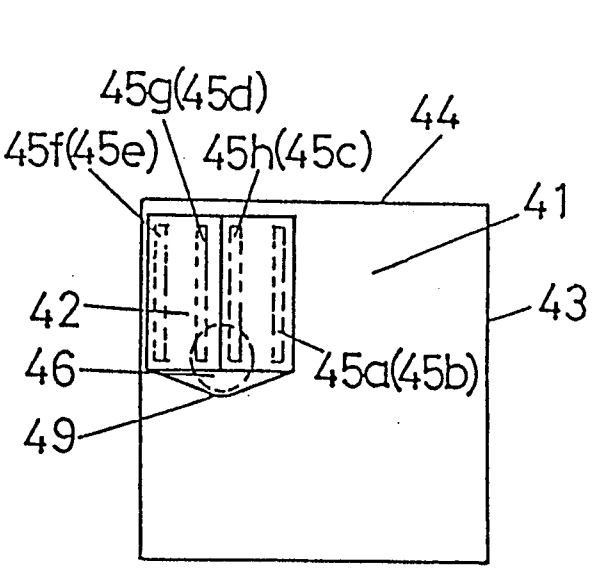
FIG. 8B is a right side perspective view thereof and FIG. 8C is a right side perspective view of the state of non-use thereof.
Figure 8B:
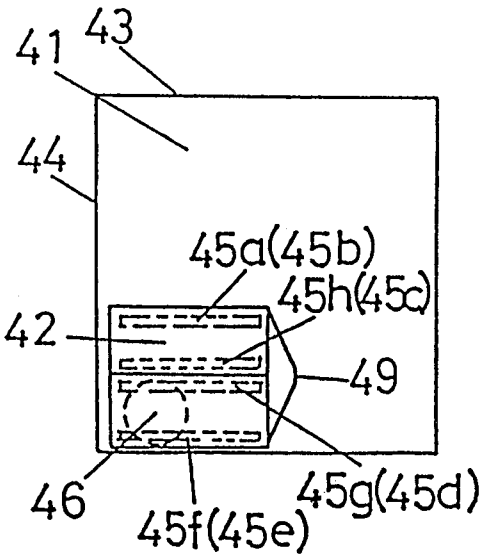
Figure 8A:
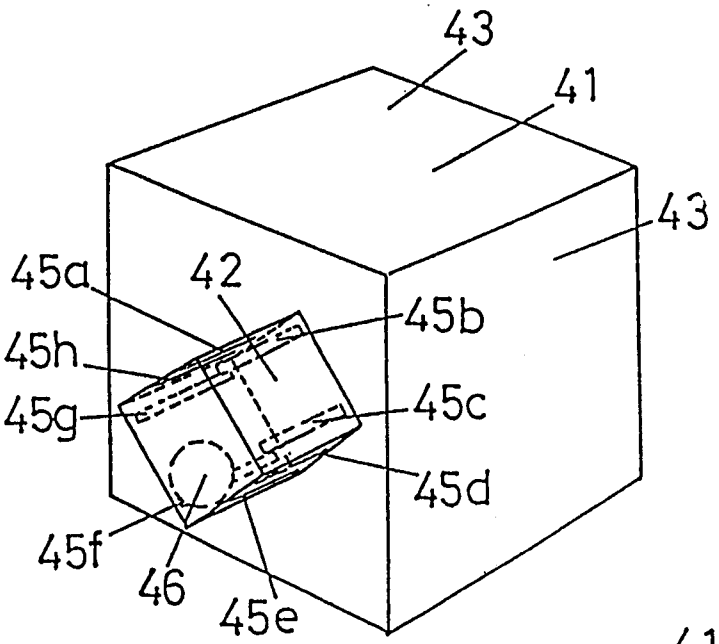
FIG. 8A is a perspective view of still another embodiment of the structure of the timer according to the present invention.

FIG. 8 is another embodiment of the timer according to the present invention. As illustrated in FIG. 8, when the bottom of a time setting device 42 is formed to have a curved face 49, a spherical conductor 46 is allowed to be received at said curved face 49 without any fear of contacting the other ON-contacts unnecessarily.

Figure 9C:
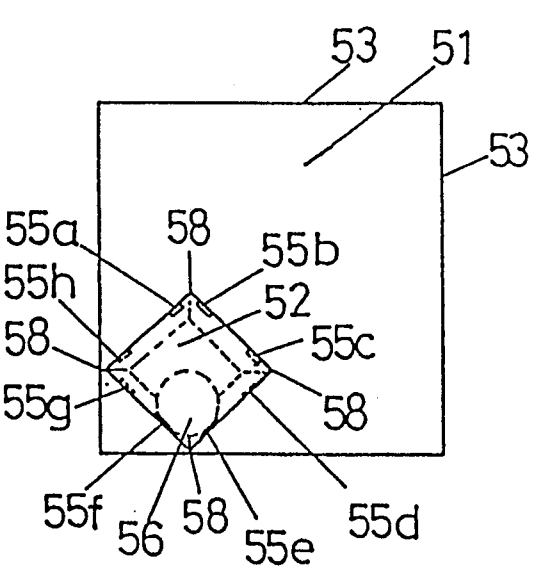
FIG. 9B is a right side perspective view thereof and FIG. 9C is a front perspective view thereof.
Figure 9B:
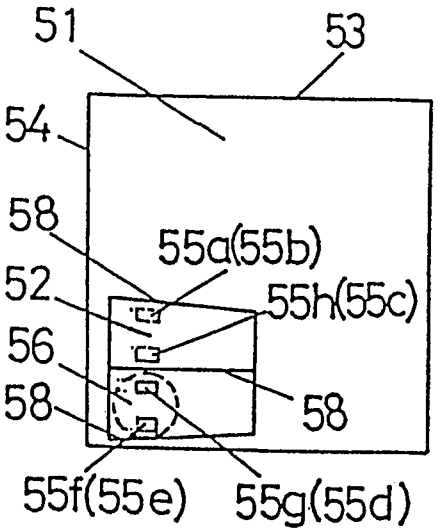
Figure 9A:
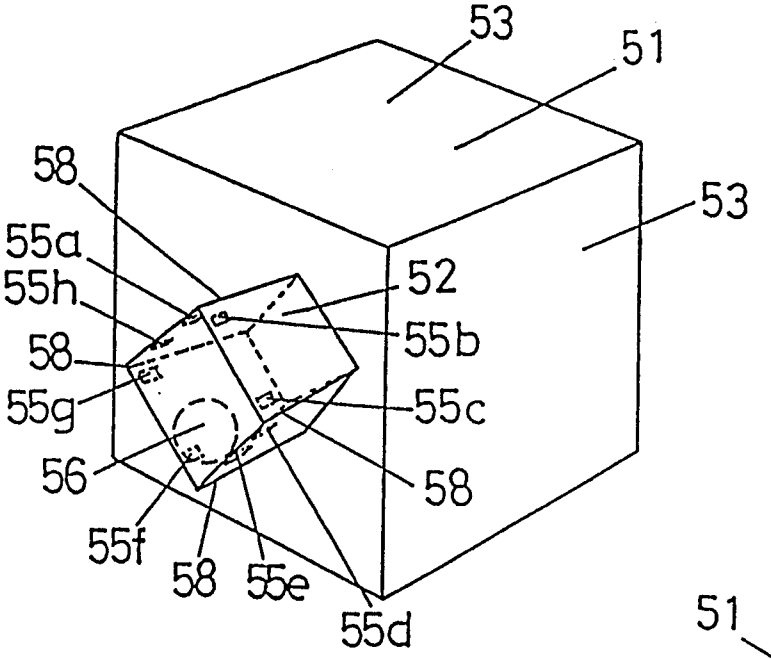
FIG. 9A is a perspective view of another embodiment of the structure of the timer according to the present invention.

As illustrated in FIG. 9 showing another embodiment of the timer according to the present invention, furthermore, when ON-contacts 55*a* . . . 55*h* are displaced aside toward either of the lids of the upper and lower openings. Further, a time setting device 52 is formed to extend in the shape of taper toward the ON-contacts 55*a* . . . 55*h*, the inclined line of the connecting portion 58 of the side plate of said time setting device 52 toward said ON-contacts is formed. Therefore, there is no fear of releasing the conduction state due to rolling down of the spherical conductor 56 even if said ON-contacts are not in the shape of a stick.

Figure 10C:
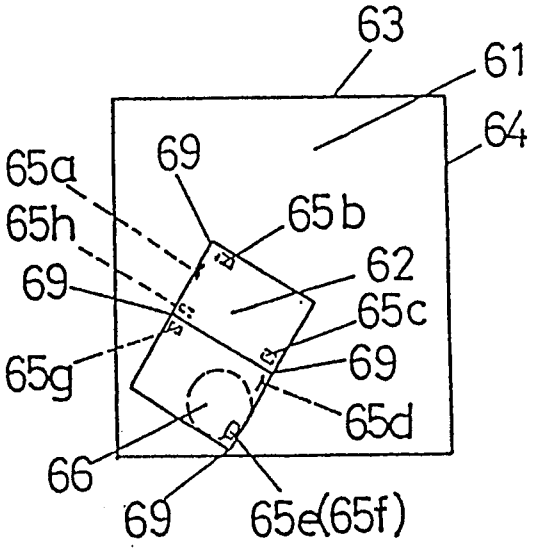
FIG. 10B is a front perspective view thereof and FIG. 10C is a right side perspective view thereof.
Figure 10B:
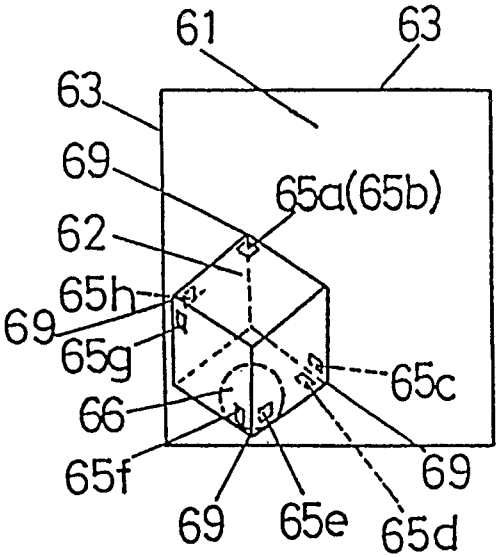
Figure 10A:
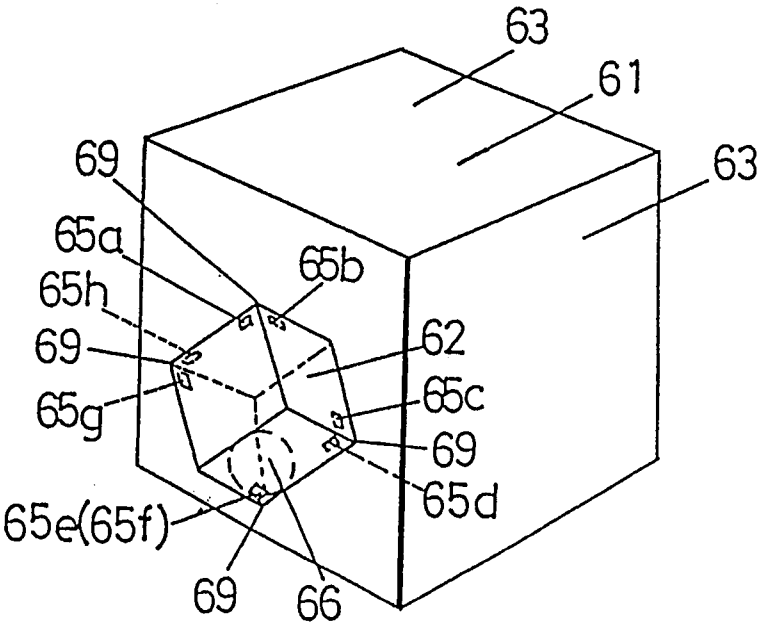
FIG. 10A is a perspective view of another embodiment of the structure of the timer according to the present invention.

A timer illustrated in FIG. 10 is constituted in a manner such that four square side plates 63 are connected to each other to form a quadrilateral cubic main hollow body 61. A pair of ON-contacts 65*a* . . . 65*h* are mounted at the inner surfaces of the side plates of a time setting device 62 having a reduced and almost the same pattern with that of said hollow body 61 and containing a spherical conductor 66 mounted at an opposing position between apexes 69 . . . 69 of said side plates of the device 62. Further, said time setting device is fixed to the inner surfaces of said hollow body 61 by rotating $360°/2n$ (n=the number of an angle of a polygon), i.e., 45° in the horizontal and vertical directions from a parallel state. This is another embodiment of the timer according to the present invention wherein the displacement of the time setting device in the hollow body is modified as the timer illustrated in FIGS. 5–7.

Figure 11:
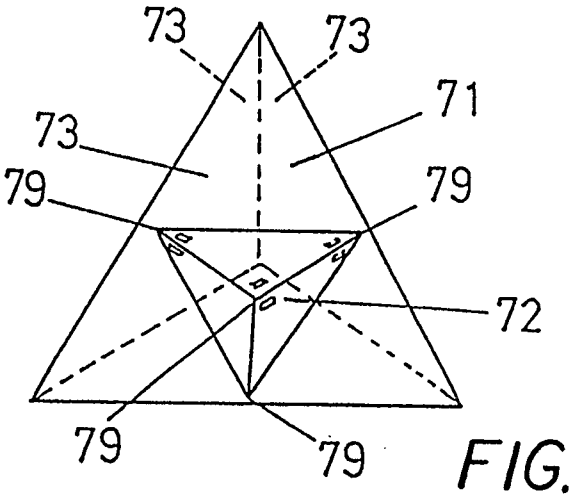
FIG. 11 is a perspective view of another embodiment of the structure of the timer according to the present invention illustrated in FIG. 10.

A timer illustrated in FIG. 11 is constituted in a manner such that three regular triangular side plates 73 are connected to each other to form a main hollow body 71 i.e., a regular triangular cube. A time setting device 72 having a reduced and almost the same pattern with that of said main hollow body 71 is fixed to the inner surfaces of said body 71 by rotating $360°/2n$ (n=the number of an angle of a polygon) i.e. in the horizontal and vertical directions from a parallel state. This is another embodiment of the timer according to the present invention. Accordingly, it is possible to obtain a desired timer with a regular cube with the same technical concept as above described.

Figure 12:
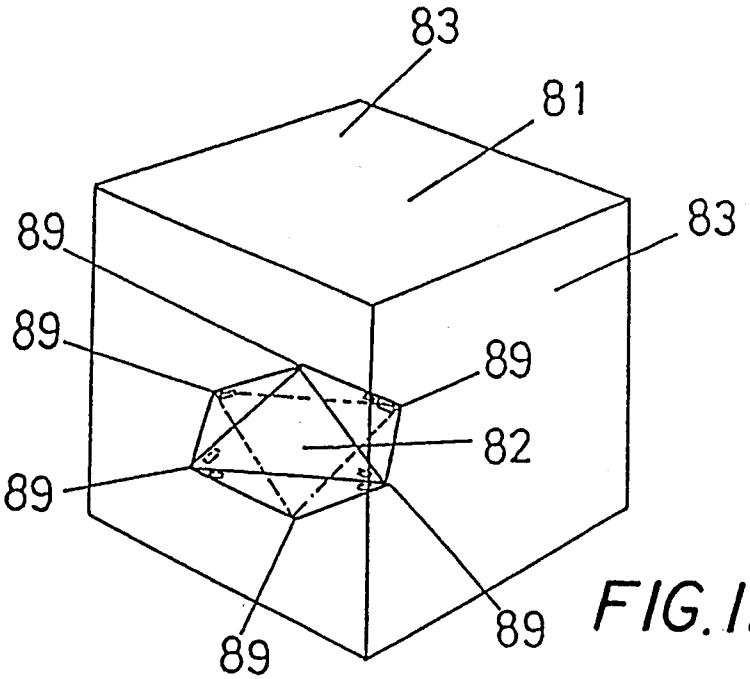
FIG. 12 is a perspective view of another embodiment of the structure of the timer according to the present invention.

A timer illustrated in FIG. 12 is constituted in a manner such that square or rectangular side plates 83 are connected to each other to form a main hollow body 81. A time setting device 82 having the same number of apexes 89 . . . 89 with that said hollow body 81 and further provided with ON-contacts mounted at each apex of said time setting device is fixed to the inner surfaces of said hollow body 81 so that the apexes of said device 82 are opposed to the side plates of said hollow body 81. Just like the timers illustrated in FIGS. 5–7, 10 and 11, this is another embodiment of the timer according to the present invention, wherein the displacement of the time setting device to the hollow body is modified. Therefore, a timer having a desired configuration can be obtained even when the configurations of the hollow body and the time setting device are not the same as illustrated in FIGS. 1–11.

As described above, according to the timer of the present invention, it is possible to set a prescribed time or the other embodiments quite easily and further possible to avoid such troublesome difficulties in setting such time which is frequently used in everyday life on all occasions because the pair of ON-contacts are preliminarily and independently set up. Furthermore, it is also possible to obtain a timer having a plurality of embodiments such as a calendar, a watch and a thermometer in addition to a timer itself. A configuration of the timer according to the present invention is very attractive in appearance which is worthy of an interior design.

What is claimed is:

1. A timer comprising:

a polygonal cubic frame formed by connecting a plurality of square or rectangular side plates to each other and having upper and lower openings, a main hollow body (1) constituted by said polygonal cubic frame and lids (4, 4*a*, 4*b*) with the configuration corresponding to that of the upper and lower openings of said polygonal cubic frame, a time setting device (2) containing side plates, a spherical conductor (6) and further provided with two ON-contacts (5, 5) in the shape of a stick mounted at each inner surface of the side plates of said device (2) having a reduced and almost the same pattern as that of said main hollow body, a circuit (C) which actuates different functions being set up at each of said ON-contacts adjacent each other mounted at the side plates of the time setting device (2), and said device (2) being fixed to the main hollow body (1) within said body in a manner such that the side plates of said device and main hollow body are parallel, thereby conducting the pair of ON-contacts through said spherical conductor so as to actuate said circuit.

2. A timer comprising:

a polygonal cubic frame formed by connecting a plurality of square or rectangular side plates to each other and having upper and lower openings, a main hollow body (1) constituted by said polygonal cubic frame and lids (4, 4*a*, 4*b*) with the configuration corresponding to that of the upper and lower openings of said polygonal cubic frame, a time setting device (2) containing side plates, a spherical conductor (6) and further provided with two ON-contacts (5, 5) in the shape of a stick mounted at each inner surface of the side plates of said device (2) having a reduced and almost the same pattern as that of said main hollow body, a circuit (C) which actuates different functions being set up at each of a pair of ON-contacts adjacent each other mounted at the side plates of said time setting device through connecting portions of said side plates, and the side plates of said hollow body that of the time setting device being shifted $360°/2n$ (n=the number of an angle of a polygon) from a parallel state through rotation, thereby actuating the circuit due to the conduction of the pair of ON-contacts by means of said spherical conductor.

3. A timer housing comprising:

a rectangular polygonal cubic main hollow body (31) formed by connecting a plurality of regular polygonal side plates (33) with the same pattern to each other, a time setting device (32) containing side plates, a pair of ON-contacts mounted at each apex formed by the side plates of said time setting device (32) having a reduced and almost the same pattern as that of said main body (31) and at a position between connecting portions of the side plates of said time setting device (32) further containing a spherical conductor, and the side plates of said main hollow body and time setting device displaced within said hollow body being shifted $360°/2n$ (n=the number of an angle of a polygon) in the horizontal and vertical directions through rotation.

4. A timer housing comprising:

a polygonal cubic main hollow body (21) having an optional confirmation and formed by side plates, a timing setting device (22) containing side plates, a spherical conductor and a pair of ON-contacts mounted at an inner surface aside each apex of said time setting device (22) at an opposing position between connecting portions of said side plates of said time setting device having the same number of faces of the side plates and apices of said hollow body (21), and said setting device (22) being mounted within said hollow body in a manner such that an apex of said time setting device may be opposed to an inner surface of a side plate of said hollow body.

* * * * *